US005189968A

United States Patent [19]

Eichenseer

[11] Patent Number: 5,189,968

[45] Date of Patent: Mar. 2, 1993

[54] DIGITAL CONTROLLER WITH A.C. INDUCTION DRIVE FOR SEWING MACHINES

[75] Inventor: Terry I. Eichenseer, Webster Groves, Mo.

[73] Assignee: Brown Group, Inc., St. Louis, Mo.

[21] Appl. No.: 583,150

[22] Filed: Sep. 17, 1990

[51] Int. Cl.[5] ..... D05B 19/00

[52] U.S. Cl. ..... 112/121.11; 112/275; 318/269; 318/616

[58] Field of Search ..... 112/220, 275, 277, 221, 112/121.11; 318/567, 569, 269, 270, 268, 369, 254, 618

[56] References Cited

U.S. PATENT DOCUMENTS

| | | | |
|---|---|---|---|
| 3,832,613 | 8/1974 | Bernstein et al. | 318/269 |
| 4,517,909 | 5/1985 | Neki et al. | 112/275 |
| 4,692,676 | 9/1987 | Dohi et al. | 112/275 X |
| 4,706,588 | 11/1987 | Fujikawa | 112/275 X |
| 5,006,770 | 4/1991 | Sakamoto et al. | 318/618 X |

*Primary Examiner*—Peter Nerbun
*Attorney, Agent, or Firm*—Polster, Lieder, Woodruff & Lucchesi

[57] ABSTRACT

Apparatus for use with an A.C. induction motor drive for a sewing machine to supplant a clutch-brake mechanism by supplying an A.C. induction motor drive to supply power to the motor to control its operating speed and needle position. The control embodies a programmable controller responsive to information loaded into it to derive a profile of how the sewing machine is to operate to sew workpieces, and to generate a control signal which is supplied to the motor drive to operate the motor in accordance with the profile in association with a speed command encoder responsive to a manipulative operator control to produce speed signals to speed up or slow down. The encoder senses the position of the motor and provides a position signal representative of the needle and signals the controller in a closed-loop control system.

8 Claims, 3 Drawing Sheets

DIGITAL CONTROLLER WITH A.C. INDUCTION DRIVE FOR SEWING MACHINES

BACKGROUND OF THE INVENTION

1. Field of the Invention

This invention is directed to a digital electronic controller with an A.C. induction drive and a shaft encoder to replace control means on industrial machines, for example, industrial sewing machines.

2. Description of the Prior Art

Industrial sewing machines, dating 1950–60s, employ an A.C. induction, fractional horsepower motor and a clutch-brake drive to impart motion to the sewing head. Machines with drives of this vintage require the operator to manually modulate the clutch and brake to control sewing speed. The method for modulation is via a spring loaded lever arm coupled directly to the clutch-brake drive whereby the operator uses the side of the leg to push and release the lever arm with a lateral motion. Pushing the arm to the side releases the brake and engages the motor with the output shaft using the clutch. Releasing the arm disengages the clutch and applies a braking force. Admittedly low in its degree of speed regulation and high in frictional content, clutch-brake drives continue to be manufactured and used today because of low initial cost. This type of control system is referred to as a manually controlled clutch-brake drive.

With the development of integrated circuits and power transistors, an industrial controller was devised and built (1960–70s) which could accept the operator's speed command from the stroke of a foot pedal. No lever arm was incorporated to directly control the clutch and brake. Instead, the foot pedal mechanism is mechanically coupled to a position sensing device which is wired to the electronic controller. The stroke of the foot pedal is converted by the controller into two modulated output signals, each having opposite phase. Both output signals are wired to two solenoids in the clutch-brake housing. One signal energizes the clutch solenoid and the other energizes the brake solenoid. A longer stroke decreases the duty cycle of the brake signal and increases the duty cycle of the clutch signal, thereby increasing the sewing speed. A shorter stroke has the opposite effect whereby the sewing speed is reduced. The operator no longer uses the side of the leg to move a spring loaded lever arm, but rather uses the foot to control a pedal much like an accelerator pedal in a car. The foot pedal motion modulates the electronic signals that control solenoid action. The solenoids provide the force to engage or disengage the clutch-brake mechanism. This type of control system is referred to as an electronically controlled clutch-brake drive.

Motion controllers targeted for sewing machine applications have recently taken on a slightly different form. In 1986, Juki and Quick-Rotan announced production availability of a brushless D.C. motor (BLDC), electronic drive, and a digital controller programmed for sewing applications. The BLDC uses magnets on the rotor to interact with a rotating field to produce rotor torque. The electronic drive precisely controls the rotating field as a function of rotor position and command input to the drive. The BLDC is typically more expensive to manufacture than the A.C. induction motor, but the BLDC's response is linear and the electronic drive does not rely on friction as does the clutch-brake drive. This results in better response and less maintenance. But to retrofit a machine with this control system means to remove a good, low-cost A.C. induction motor and replace it with the BLDC motor.

BRIEF DESCRIPTION OF THE INVENTION

The invention consists of a digital electronic controller, an A.C. induction drive and a 600-line shaft encoder. It is designed as a retrofit package, to retrofit machines with manually modulated clutch-brake drives or electronically modulated clutch-brake drives. This invention utilizes the existing A.C. induction motor currently installed on such a machine and enhances the machine functionally via the programmable features of the digital controller.

The objects of the invention are to provide: precise speed regulation because of the closed-loop feedback control; to provide control changes in speed command by a trapezoidal velocity profiler for maintaining a linear rate of change; to provide an A.C. induction drive to replace an existing clutch-brake drive to reduce maintenance requirements associated with a clutch-brake drive; to provide programmable servo coefficients which allow custom damping control; and to provide soft-landing whereby the deceleration rate of the motor is dynamically lowered to increase position accuracy. As a retrofit package, the aforementioned objects are provided while utilizing the existing A.C. induction motor on the machine.

BRIEF DESCRIPTION OF THE DRAWINGS

The invention is depicted in its current embodiment in the following drawings, wherein.

DESCRIPTION OF A PREFERRED EMBODIMENT

Figure 1:
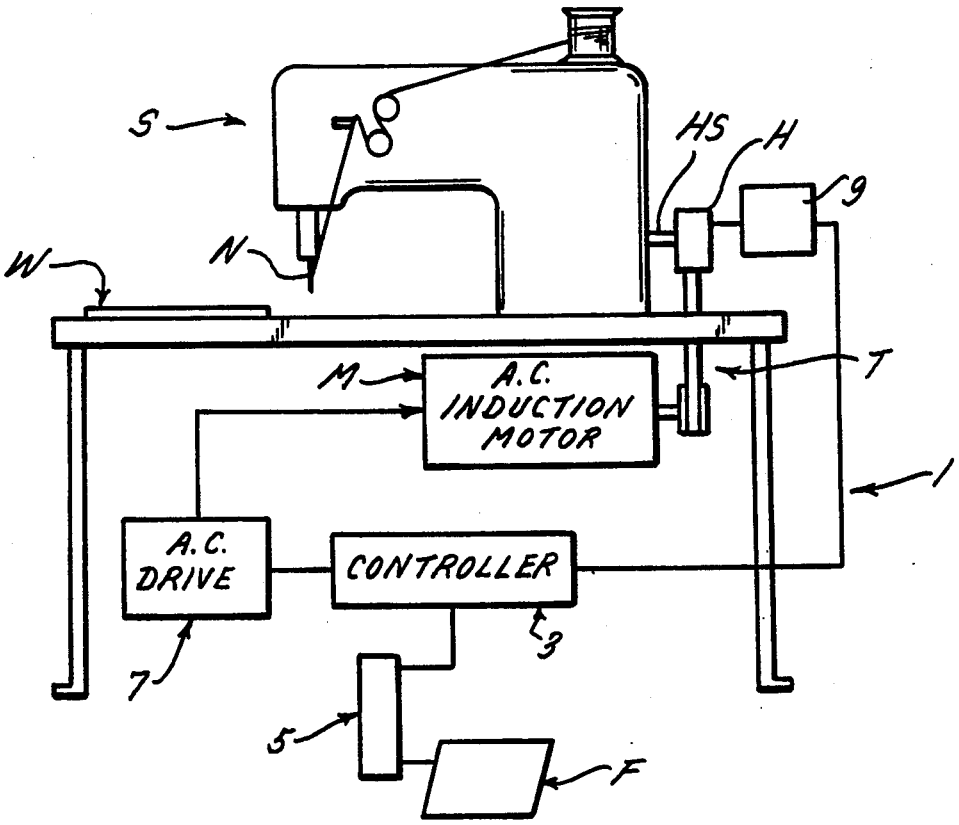
FIG. 1 is a schematic view of a sewing machine having the control system of the embodiment.

It is deemed useful to make a comparison between certain features of the older sewing machine control and the present improved automatic sewing machine controls. A sewing machine S shown in FIG. 1 is, for example, an industrial type sewing machine. Machine S is used to sew various workpieces W. Machine S is a motor driven machine which may be actuated by a motor M, for example, an A.C. induction motor. The sewing machine may thus be of the type well-known in the art in which an operator (not shown) sitting or standing by the machine uses a foot pedal F or lever arm (lever arm not shown on the machine depicted in FIG. 1) to control machine operation.

In the automatic system, a servomechanism consisting of a controller box, an electric A.C. drive, an A.C. induction motor, a belt-pulley arrangement, and machine mechanical components, controls needle movement. With the advances in microchip and computer control technology, it is now possible to impart a much finer degree of control over many operations, such as sewing, which previously were solely dependent upon the skill of the operator to perform. In this regard, apparatus 1 of the present invention is for use with an improved sewing machine S and may be installed either as original equipment on the machine, or it may be retrofitted to replace either the older manually activated (lever arm) clutch-brake unit or the somewhat newer automatic clutch-brake arrangement. The improvement described hereinafter is advantageous in that it provides for very precise control over sewing operations. As shown in FIG. 1, apparatus 1 includes a programmable controller 3 which controls sewing operations in response to both information entered into it about the position and timing of machine sequences, as well as external inputs such as movement of foot pedal F by a machine operator. A speed encoder 5 is sensitive to operator movement of the foot pedal to convert the position, and change in position, of the foot pedal to an input signal to the controller. This signal will tell the controller at what speed the machine should be running, and whether or not it should speed-up, slow-down, start, or stop. Controller 3 generates and supplies control signals to an A.C. drive 7. Drive 7 controls operation of motor M to control the operating speed of the motor. The motor runs machine S through a transmission system T which includes a servomechanism H. As a workpiece W runs through the machine, the position of the sewing needle N relative to the workpiece is a function of the position of shaft HS. A shaft encoder 9 is located adjacent to shaft HS and continuously monitors the shaft position to provide an indication thereof to controller 3. From the foregoing, it will be evident that apparatus 1 provides a closed loop control system for controlling machine operations.

Figure 2:
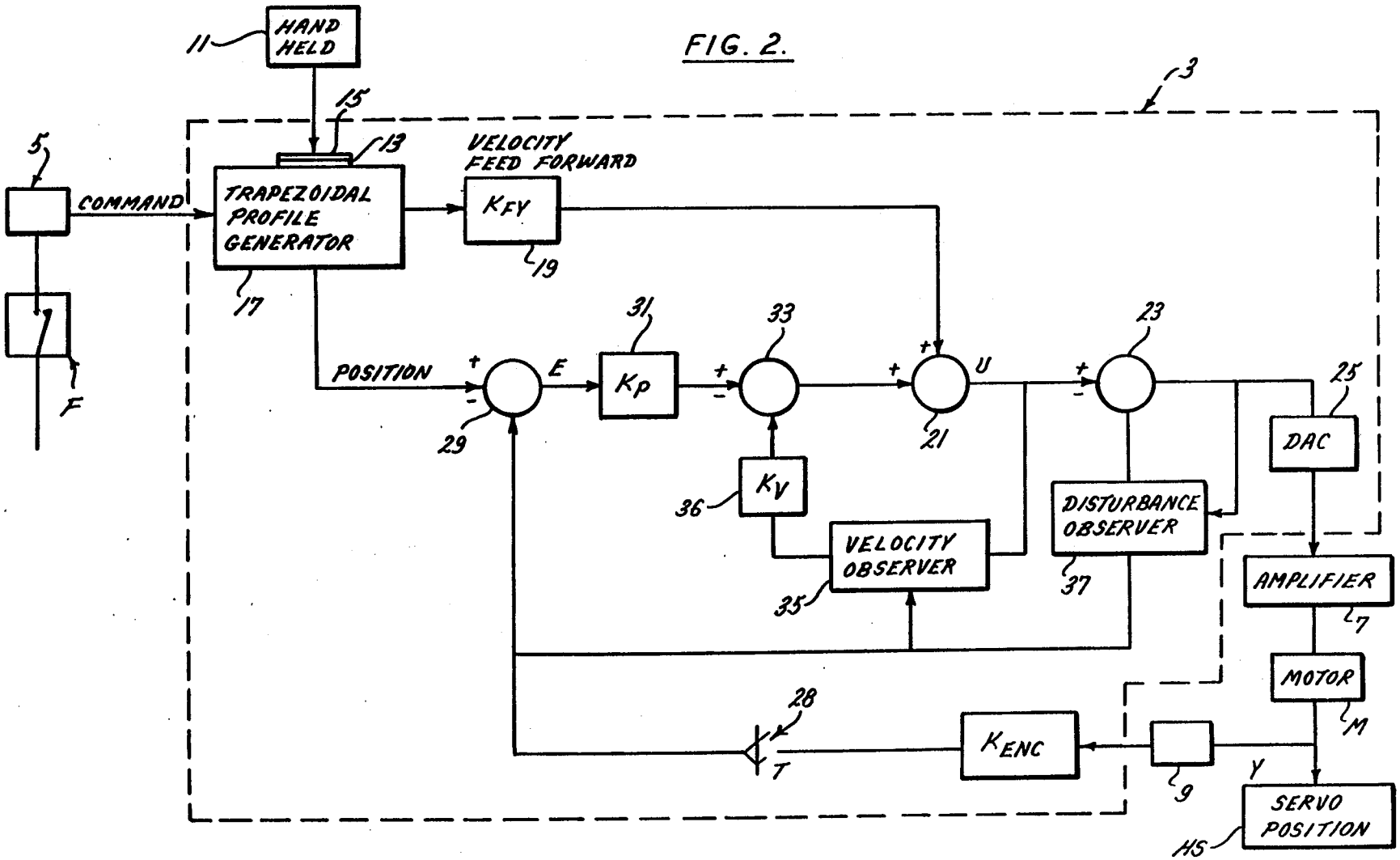
FIG. 2 is a schematic diagram of a single axis motion system for the controller, A.C. drive, and motor of the sewing machine of FIG. 1.

Referring to FIG. 2, apparatus 1 is shown in more detail. Controller 3 depicted in outline is a programmable controller into which are entered gain parameters to control damping characteristics along with position and timing sequences. The controller has a sewing control program (SCP) permanently loaded into its memory for a particular type of sewing operation but also has this capability to be uniquely programmed for different sewing operations. The SCP allows position and timing sequences to be finely tuned for a particular machine. This is done using the programming unit 11. For this purpose, the controller has a port or terminal 13 into which a mating plug or terminal 15 of unit 11 is insertible. In operations where many sewing machines are employed at one side, with some performing one task and some another, unit 11 may be a hand held unit which is readily transportable from one machine to another to separately program each machine. Using unit 11, the following parameters are programmable into controller 3:

a) discrete (up to 12) rates of motor speed at which encoder 5 can command the controller to run motor M;
b) motor acceleration or rate of change of speed;
c) dwell time, or the amount of time the needle will remain in a workpiece during a thread cut;
d) the position of shaft HS with the needle in the workpiece ("needle down");
e) the position of shaft HS with the needle out of the workpiece ("needle up");
f) the position of shaft HS for thread cut (this may be the same as d);
g) the duration (pulse width) of the thread cut signal;
h) servomechanism gain parameters for custom damping.

Figure 3:
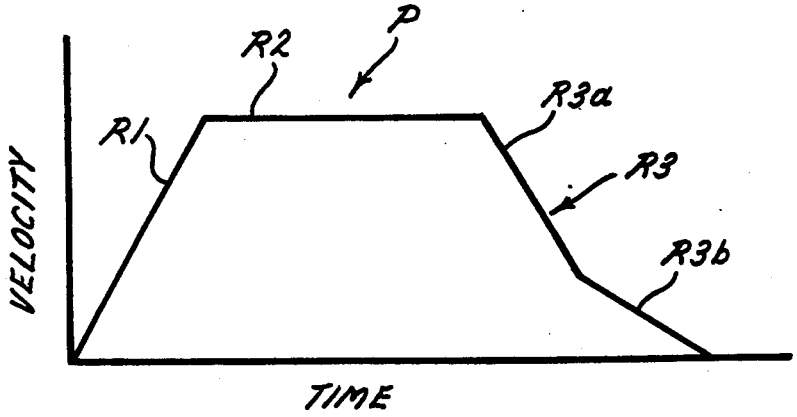
FIG. 3 is a plot of the soft-landing technique for accurate positioning of the sewing machine needle.

The controller includes a trapezoidal profile generator 17 which, in response to the entered information, creates a trapezoidal profile P (See FIG. 3) for the machine's operation. The purpose of the trapezoidal profile is to produce a linear rate of change when the motor is sped up or slowed down during machine operation. An exemplary profile is shown in FIG. 3 as having a linear acceleration ramp R1, a constant velocity section R2, and a linear deceleration ramp R3. It will be noted that ramp R3 has two sections, a section R3*a* which represents an initial portion of a motor deceleration, and a second and more gradually sloping section R3*b*. This latter section is for the terminal part of the deceleration and effects a "soft" rather than abrupt termination of motor operation.

Regardless of the profile, when the operator (See FIG. 2) depresses the foot pedal F, holds it in a given position, or releases it, its instantaneous position is sensed by speed command encoder 5. The encoder converts this foot pedal position into a motor speed command signal which is supplied to the controller. Controller 3 responds to this input by determining the current rotational speed command of motor M to determine the degree to which motor speed must change. Then, a digital control signal is generated by profile generator 17 and is supplied to a velocity feed forward amplifier 19. The amplified signal is then supplied to a summing point 21. From there, the supplied signal is one input to a second summing point 23. The output from this said second summing point is provided as an input to a digital-to-analog converter 25. The resultant motor control signal is the output of the controller and is supplied to motor drive 7 also referred to as the amplifier. The motor control signal is first amplified by an amplifier 27 of motor drive 7 and then supplied to motor M. The motor drives the servomechanism H for the sewing machine mechanical arrangement via transmission T. The encoder 9 functions such that any angular position of the shaft relative to a preset reference within each revolution can be discretely identified. For example, encoder 9 can divide the angular position of the shaft into one of 600 separate, discrete values each of which has a separate, discrete digital code associated with it as determined by a counter Kenc in the controller. Encoder 9 transmits back to controller 3 a series of electrical pulses. These pulses are automatically counted in the function Kenc. The controller employs a position sampler 28 which determines the position at selected intervals by reading the counter and it is this information which is sent to controller 3.

The position information from the sampler 28 is supplied to a summing point 29. At this point, the encoder information is summed with a position signal from profile generator 17. The position signal indicates the commanded shaft position for a particular loop update interval; while the coded signal from sampler 28 indicates the actual shaft position at that same interval. The difference between the commanded and the actual position is an error signal which is amplified by an amplifier 31 and supplied to another summing point 33. In addition to being supplied to summing point 29, the sampled encoder output signal 28 is supplied to a velocity observer module 35 which has an associated amplifier 36 and to a disturbance observer 37 of the controller. Unlike systems in which speed control is accomplished using feedback devices mounted on a motor shaft, apparatus 1 employs a "velocity observer" control strategy such as is described in "Velocity and Disturbance Observers On Your 8 Bit Micro" by Terry Eichenseer, PCIM 1989, Intelligent Motion Conference Proceedings, which is incorporated herein by reference. Both module 35 and module 37 provide closed loop feedback paths, within controller 3; module 35 responding to the output from summing point 21 to provide a feedback signal to summing point 33, and module 37 the output of summing point 23 to provide a feedback signal to the same summing point. In each instance, the feedback signal responds to the input from sampler 28.

As is readily seen in FIG. 2, apparatus 1 provides a closed loop control system in which the damping characteristics can be custom tailored to a particular sewing machine operation. Thus, in a plant utilizing numerous machines S with different mechanical characteristics, all can be readily set-up with the proper speed command response (or damping) characteristics. It will be understood that the gain factors for the various amplifiers 19, 31 and 36 shown in FIG. 2 and amplifiers 41, 43 and 45 shown in FIG. 5 are a function of the closed loop control algorithm as loaded into the controller at the time of machine retrofit.

Figure 4:
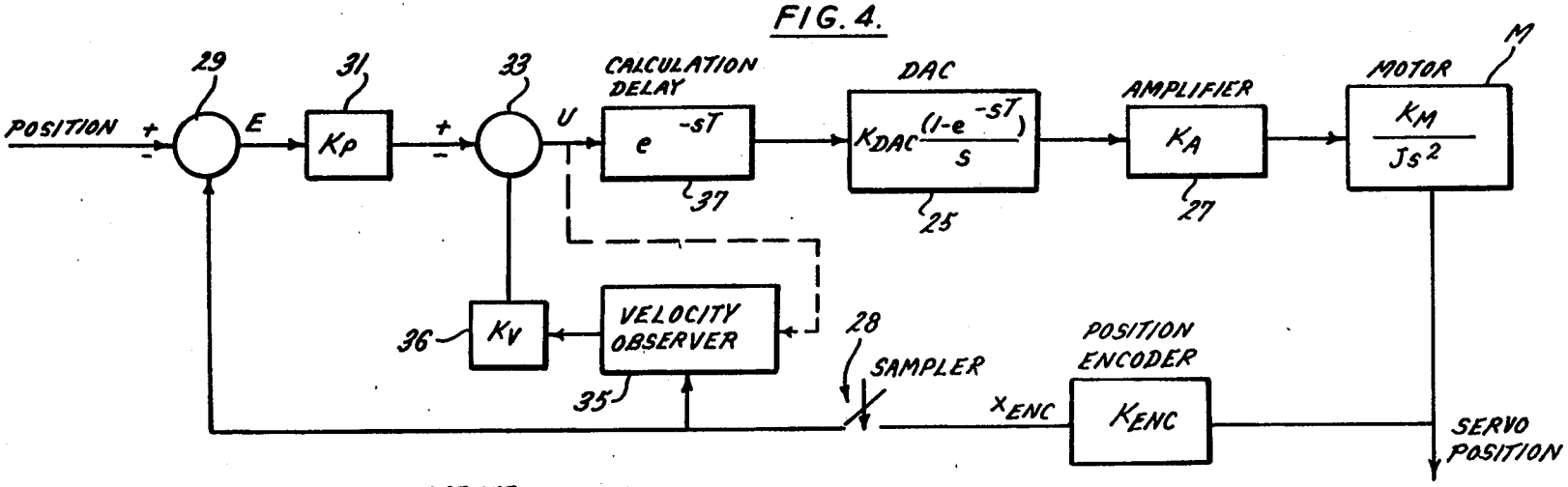
FIG. 4 is a system model that mathematically represents the dynamics of the position and velocity loops of the motion system from FIG. 2; and, FIG. 5 is a schematic diagram of the circuit in the velocity observer of FIG. 4.
Figure 5:
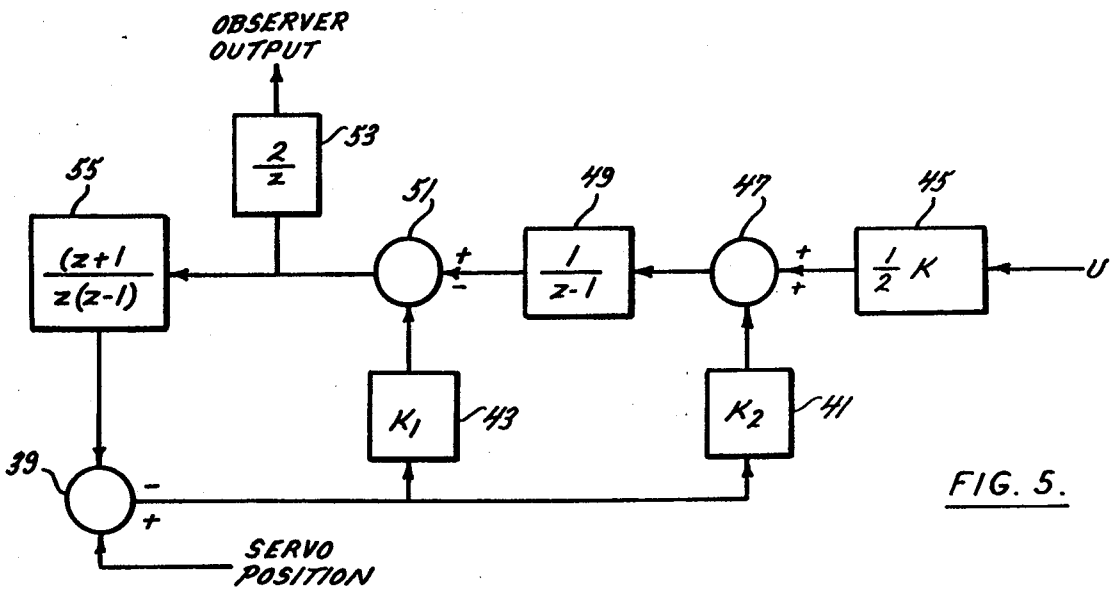

Referring to FIG. 5, velocity observer module 35 first depicted in FIG. 2 is shown to include a summing point 39 to which the input from sampler 28 is supplied. The output from this summing point is supplied to a pair of amplifiers 41 and 43. The velocity or speed signal output from summing point 21 is fed to an input of an amplifier 45. The resultant output is provided to a summing point 47 which is also supplied the output of amplifier 41. An amplifier 49 has as its input the resultant signal produced at summing point 47, and the amplifier output is directed to a summing point 51. The signal output of amplifier 43 is a second input to this summing point. The resultant output of summing point 51 is supplied to both an amplifier 53 and an amplifier 55. Since the disclosure in FIG. 5 is a rendering of the velocity observer in FIG. 4 it can also be understood that the output of amplifier 53 is provided to summing point 33, via amplifier 36; while the output of amplifier 55 is directed to a second input of summing point 39. It will be understood that the deriviation of the various gain factors for the amplifiers used in module 35 are described in the paper referenced above.

Next, FIG. 4 illustrates a system model for apparatus 1, where the system model mathematically represents the system dynamics of the position and velocity loops of FIG. 2. As shown therein, the various factors which make up elements of a control equation for the apparatus are indicated in the respective components in which they are implemented. Depending upon the type of machine S employed, particular values for the various factors will change. However, the control equation is relatively standard throughout the range of machines for which apparatus 1 is usable.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In a motor driven sewing machine having an A.C. induction motor, the improvement comprising:
   a) drive means for supplying power to the A.C. induction motor to control its operating speed and position;
   b) programmable control means into which are entered
      1. desirable damping gains for the sewing machine for a custom damping response and
      2. position and timing operating characteristics for a particular type of sewing control sequence, the control means being responsive to information entered to derive both a profile of machine response to speed commands to sew a workpiece and to generate control signals supplied to the drive means; and
   c) encoder means for sensing the position of the A.C. motor and providing a position signal representative of the A.C. motor to form a closed loop control system for operating the sewing machine, the control means being operative to adjust the speed or position of the A.C. motor in response to the sensed position of the motor.

2. The improvement set forth in claim 1 wherein the drive means, control means and encoder means constitute an automatic system.

3. The improvement set forth in claim 1 wherein the drive means comprises an A.C. induction drive to provide power to the A.C. motor.

4. The improvement set forth in claim 2 wherein a manipulative means is incorporated to effect operative control of the sewing machine, including speed command encoding means to produce a speed signal for the control means to speed up or slow down the A.C. motor.

5. The improvement set forth in claim 1 wherein the control means includes means for generating a trapezoidal profile for machine operation to produce a linear rate of change commensurate with A.C. motor speed up or slow down.

6. The improvement set forth in claim 5 wherein the means for generating a trapezoidal profile adjusts the portion of the profile representing A.C. motor deceleration rate so the rate is dynamically lowered thereby to enhance workpiece position accuracy.

7. The improvement set forth in claim 5 wherein the control means includes velocity observer means responsive to position signals from the encoder means to modify the control signal supplied to the drive means.

8. In a motor driven sewing machine the improvement of a programmable closed-loop feed back controller having means to effect changes in sewing speed commands by a velocity observer comprising a sewing machine shaft and a shaft position encoder for determining sewing needle position, a velocity observer, a shaft speed encoder operatively connected to said sewing machine shaft for continuously monitoring said sewing machine shaft positions, an AC drive motor responsive to said speed encoder and programmable closed-loop feedback controller to maintain a linear rate of speed change whereby a deceleration rate of said AC drive motor is dynamically lowered to increase needle position accuracy.

* * * * *